United States Patent [19]

Genba

[11] Patent Number: 4,650,938

[45] Date of Patent: Mar. 17, 1987

[54] ARC CHUTE FOR A CIRCUIT BREAKER

[75] Inventor: Yasushi Genba, Fukuyama, Japan

[73] Assignee: Mitsubishi Denki Kabushiki Kaisha, Tokyo, Japan

[21] Appl. No.: 713,543

[22] Filed: Mar. 19, 1985

[51] Int. Cl.[4] ..... H01H 33/02

[52] U.S. Cl. ..... 200/144 R; 200/147 R

[58] Field of Search ..... 200/147 R, 147 B, 144 R

[56] References Cited

U.S. PATENT DOCUMENTS

| | | | |
|---|---|---|---|
| 3,031,552 | 4/1962 | Stewart | 200/147 B |
| 3,296,402 | 1/1967 | Meinders | 200/147 B |
| 3,374,332 | 3/1968 | Bould | 200/147 B |
| 4,446,347 | 5/1984 | Eguchi et al. | 200/144 R |

*Primary Examiner*—Robert S. Macon

*Attorney, Agent, or Firm*—Leydig, Voit & Mayer

[57] ABSTRACT

An arc chute for a circuit breaker comprises a plurality of spaced apart arc plates which are to be disposed in proximity to arc contacts and which guide the hot gas caused by arcs generated by the opening of the circuit breaker contacts, a pair of side members for retaining the arc plates, and deflector projections disposed on the inner sides of the side members to which the arc plates are attached. Each projection is spaced from the ends of the arc plates on the contact side, and project toward the opposing side member such that the gas flow is not directed to the inner sides of the side members.

5 Claims, 16 Drawing Figures

ARC CHUTE FOR A CIRCUIT BREAKER

BACKGROUND OF THE INVENTION

The present invention relates to an arc chute in a circuit breaker, such as a low-voltage air circuit breaker, for interrupting a relatively large current. In particular, it relates to an improvement for the structure of side members for retaining a plurality of spaced apart arc plates in the arc chute.

In this kind of the conventional circuit breaker such as a circuit breaker disclosed in U.S. Pat. No. 3,296,402, an arc chute comprises a plurality of arc plates of a magnetic material spaced apart from one another, and a pair of side plates of an insulating material for retaining the arc plates on both sides thereof. The arc plates are secured to the side plates by bolts and nuts using upper and lower insulating plates such that the arc plates are spaced from each other with a predetermined separation therebetween.

In such an arc chute, the arc plates are disposed to oppose a switching track of stationary and movable contacts, and arcs generated by the opening operation between the stationary and movable contacts are drawn to the arc plates by an electromagnetic action caused by the arc plates. The arcs are then segmented, cooled, and extinguished by the arc plates. However, since the temperatures of the arcs are high, the arcs heat the atmosphere therearound and generate hot gas. The hot gas is discharged to the exterior of the arc chute through the space between the arc plates. Therefore, side plate portions near the arcs are damaged by the heat of the hot gas, and the dielectric breakdown of the side plates is thereby caused, worsening the performance of the arc chute. The dielectric breakdown due to the heat damage is especially severe in portions of the side plates in which the arc plates are attached and retained.

SUMMARY OF THE INVENTION

To overcome the above disadvantages, an object of the present invention is to provide an arc chute for a circuit breaker in which the damage of the arc chute due to the hot gas caused by arcs generated by the opening of contacts is greatly reduced, and the dielectric breakdown of the arc chute is reduced, thereby maintaining the performance of the arc chute and obtaining a durable arc chute.

With the above object in view, the present invention resides in an arc chute for a circuit breaker comprising a plurality of spaced apart arc plates which are to be disposed in proximity to arc contacts and which guide the hot gas caused by arcs generated by the opening of the contacts, a pair of side members for retaining the arc plates, and a projection disposed on the inner surface of the side members to which the arc plates are attached, the projection being spaced from the leading edges of the arc plates on the contact side and projecting toward the opposing side members such that the flow of the hot arc gas is prevented from contacting the inner side surfaces of the side members where the arc plates are supported.

BRIEF DESCRIPTION OF THE DRAWINGS

The present invention will now be described with reference to the preferred embodiments thereof in conjunction with the accompanying drawings, in which.

DETAILED DESCRIPTION OF THE PREFERRED EMBODIMENTS

Figure 1:
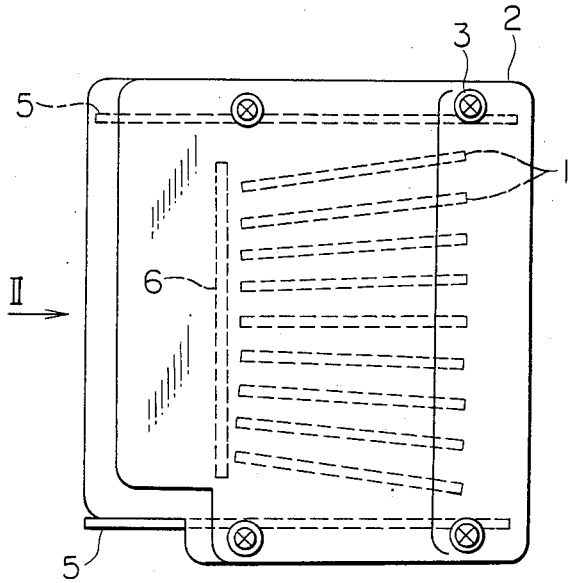
FIG. 1 is a side view showing a first embodiment of an arc chute for a circuit breaker according to the present invention.
Figure 2:
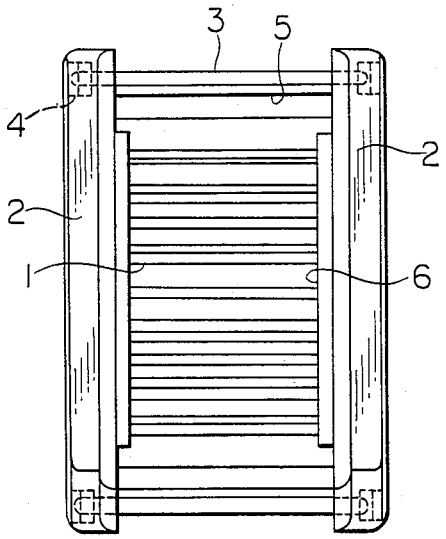
FIG. 2 is a front view of the arc chute seen from the arrow II in FIG. 1.
Figure 3A:
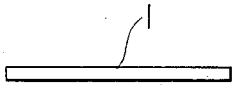
FIG. 3A is a side view of an arc plate.
Figure 3B:
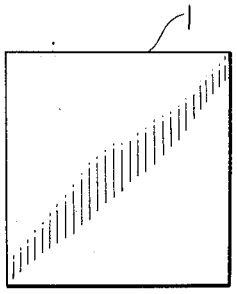
FIG. 3B is a plan view of the arc plate of FIG. 3A.
Figure 4A:
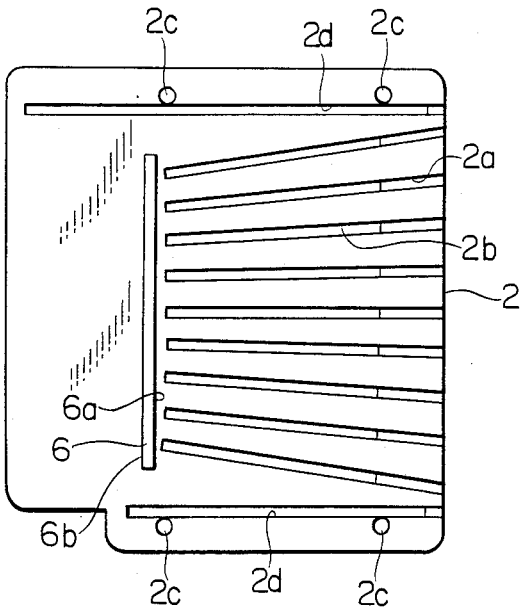
FIG. 4A is a partial side view of the first embodiment of an arc chute according to the present invention.
Figure 4B:
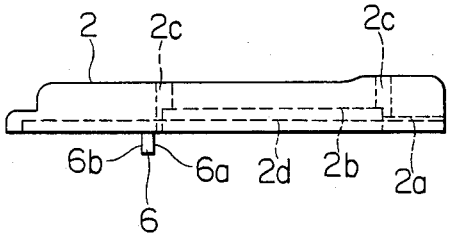
FIG. 4B is a partial plan view of the arc chute in FIG. 4A.
Figure 7:
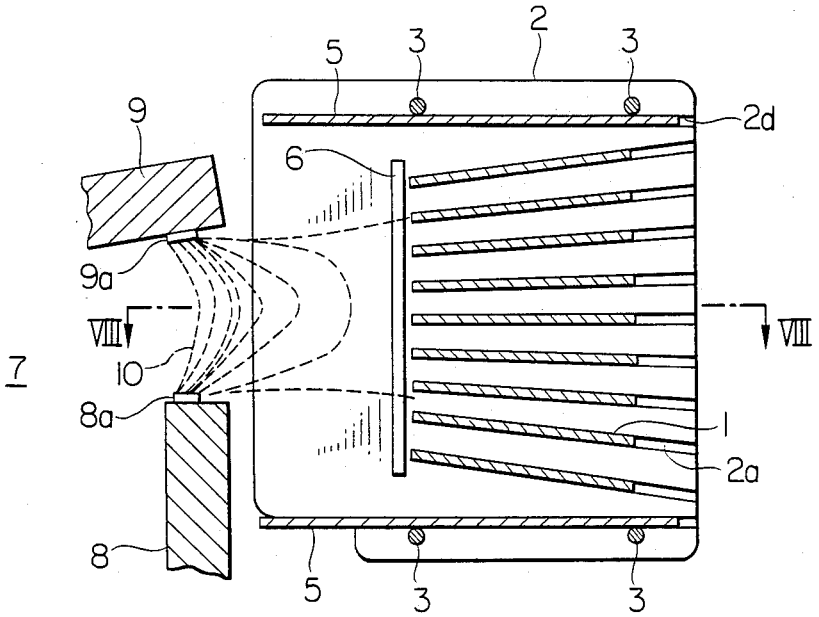
FIG. 7 is a partially sectional side view showing the arc chute in FIG. 4A in combination with a switch.
Figure 8:
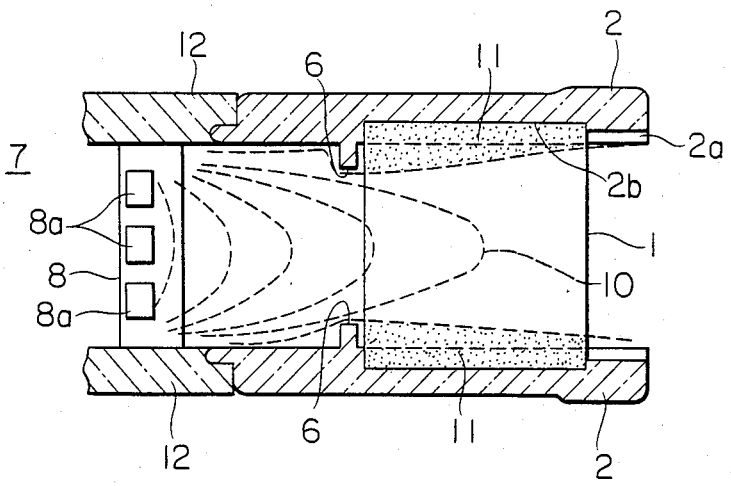
FIG. 8 is a partially sectional plan view of the arc chute taken along Line VIII—VIII in FIG. 7.

As shown in FIGS. 1 to 3, an arc chute according to the present invention comprises a plurality of spaced apart arc plates 1 made of a magnetic material, and a pair of spaced apart parallel side members 2 such as side plates made of an insulating material. As shown in FIGS. 4A and 4B, each side member 2 has first grooves **2*a* for receiving the arc plates 1, second grooves 2*b* communicated with the first grooves 2*a* to secure the arc plates 1 to the side members 2, holes 2*c* for receiving bolts 3, and third grooves 2*d* for retaining insulating plates 5. Deflector means, herein shown as an elongated projection 6, is disposed on the inner side of each side member 2 to which the arc plates 1 are attached. The projection 6 extends substantially perpendicularly to the arc plates 1 and projects toward the opposing side members 2 such that, as shown in FIGS. 7 and 8, the flow of the hot arc gas caused by electric arcs 10 generated by the opening of stationary contacts 8*a* and movable contacts 9*a* is deflected and prevented from contacting the portions of the inner side faces of the side members 2 where the arc plates 1 are held. The projection 6 is spaced from the ends of the arc plates 1 on the contact side to prevent the heat of the arced gas from being directly transferred from the projections 6 to the ends of the arc plates 1. In the first embodiment shown in FIGS. 4A and 4B, the sides 6*a* and 6*b* of each projection 6 are generally perpendicular to the inner side surface of each side member 2**.

The side edges of the arc plates 1 are inserted into the second grooves **2*b*, and the arc plates 1 are attached to and retained between the side members 2. The arc plates 1 are secured to the side members 2 by bolts 3 and nuts 4 using the insulating plates 5. As shown in FIGS. 7 and 8, the arc chute is disposed opposite a switching track in the vicinity of the stationary contacts 8a and the movable contacts 9a in a switch 7 of a circuit breaker. A stationary conductor 8 supports the stationary contacts 8a, and a movable conductor 9 supports the movable contacts 9a. Walls 12 are connected to the side members 2** and insulate the switches adjacent to each other.

In the arc chute constituted as described above, as shown in FIGS. 7 and 8, electric arcs 10 are generated between the contacts when the movable contacts 9a are separated from the stationary contacts 8a. Since the temperatures of the arcs 10 are high, hot gas is generated around the arcs, and a large part of the hot gas is discharged to the exterior of the arc chute through the spaces between the arc plates 1. During discharge of the hot gas, the hot gas flowing along the inner faces of the side members 2 is deflected by the projections 6 and is separated from the inner surfaces of the side members 2 before the gas enters the spaces between the arc plates 1, so that the hot gas does not flow along the inner faces of the side members 2 downstream of the projection 6. Namely, by the action of the projections 6, the flow of a large part of the hot gas is deflected toward the central portion between the side members 2, and the gas is then discharged from the spaces between the arc plates 1 to the exterior of the arc chute. Accordingly, as shown in FIGS. 7 and 8, stationary regions 11 of the hot gas in which there is substantially no flow of the hot gas are formed downstream of the projections 6 along the inner sides of the side members 2. Since the projections 6 are disposed upstream of the arc plates 1 and are spaced from the ends of the arc plates 1, the stationary regions 11 are formed along substantially the entire area in which the arc plates 1 are attached to and retained by the side members 2. Thus, the hot gas flow is deflected by the projections 6 toward the central portion between the side members 2 and is prevented from contacting the portions of the inner surfaces of the side members 2 where the arc plates are held, so that the portions of the side members 2 in which the arc plates 1 are retained are prevented from being damaged by the heat of the hot gas. Since the hot gas flow is deflected and a gap is disposed between the projection 6 and each end of the arc plates 1 on the contact side, dielectric breakdown caused by damage due to the hot gas can be prevented in the portions in which the arc plates 1 are retained by the side members 2.

Figure 5A:
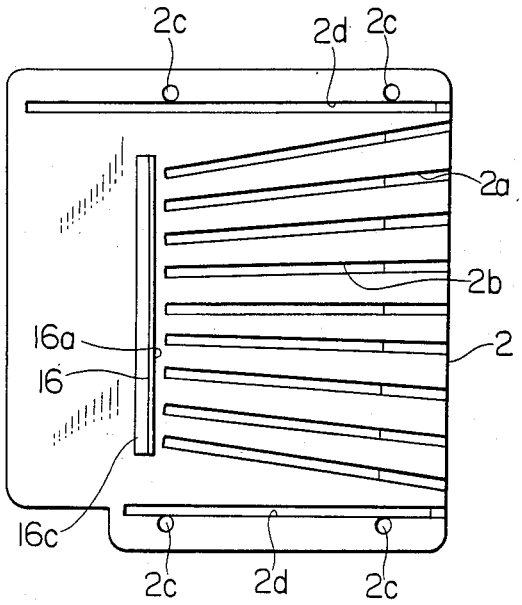
FIG. 5A is a partial side view of a second embodiment of an arc chute according to the present invention.
Figure 5B:
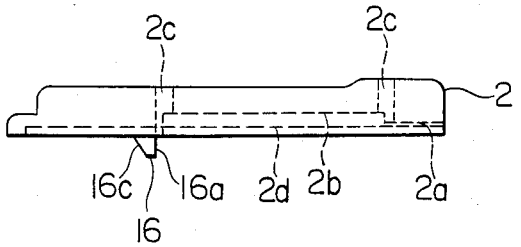
FIG. 5B is a partial plan view of the arc chute in FIG. 5A.
Figure 9:
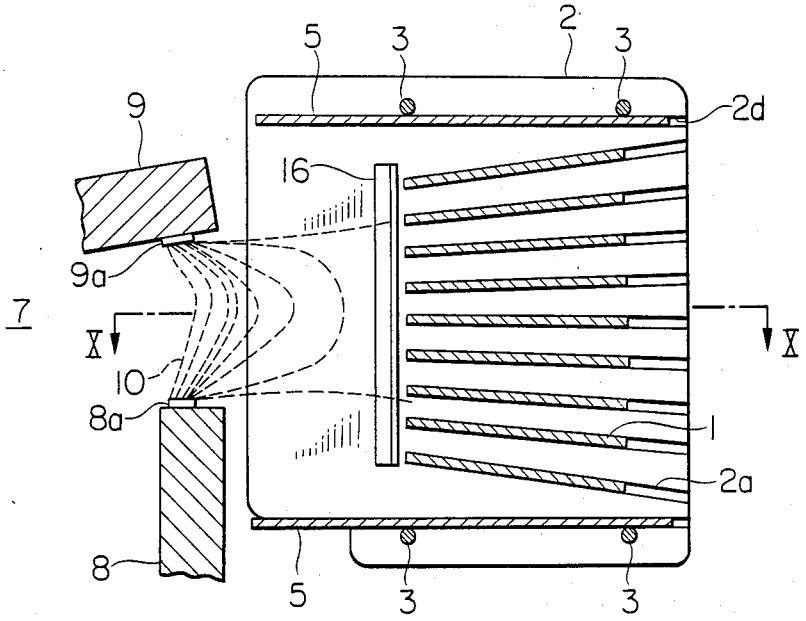
FIG. 9 is a partially sectional side view showing the arc chute in FIG. 5A in combination with a switch.
Figure 10:
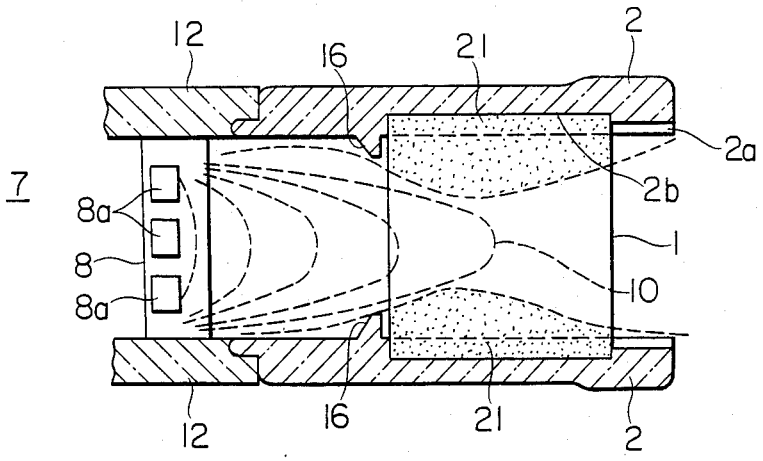
FIG. 10 is a partially sectional plan view of the arc chute taken along Line X—X in FIG. 9.

In a second embodiment shown in FIGS. 5A and 5B, each deflector projection 16 has a side surface 16a generally perpendicular to the inner side surface of each side member 2, and a slanting side surface 16c on the contact side slanting to the inner side surface of each side member 2. The slanting sides 16c are disposed such that, as shown in FIGS. 9 and 10, the hot gas is not directed to the inner sides of the side members 2 downstream of the projections 16, forming stationary regions 21 of the hot gas along the inner side surfaces of the side members 2. In other respects, the structure is similar to the structure in the first embodiment shown in FIGS. 4A and 4B.

As can be seen by comparing FIG. 8 and FIG. 10, the projections 16 with the slanting sides 16c shown in FIGS. 5A and 5B have the effect of increasing the size of the stationary regions compared with the effect obtained by the projections 6 shown in FIGS. 4A and 4B.

Figure 6A:
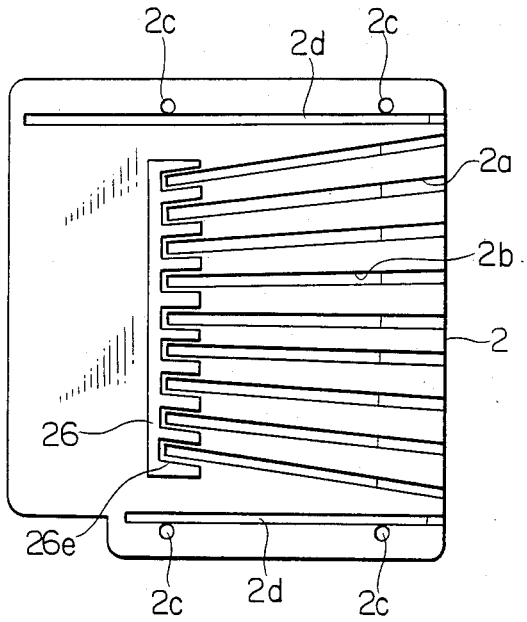
FIG. 6A is a partial side view of a third embodiment of an arc chute according to the present invention.
Figure 6B:
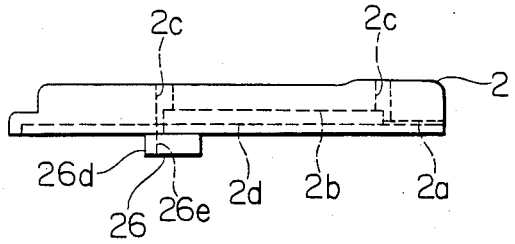
FIG. 6B is a partial plan view of the arc chute in FIG. 6A.
Figure 11:
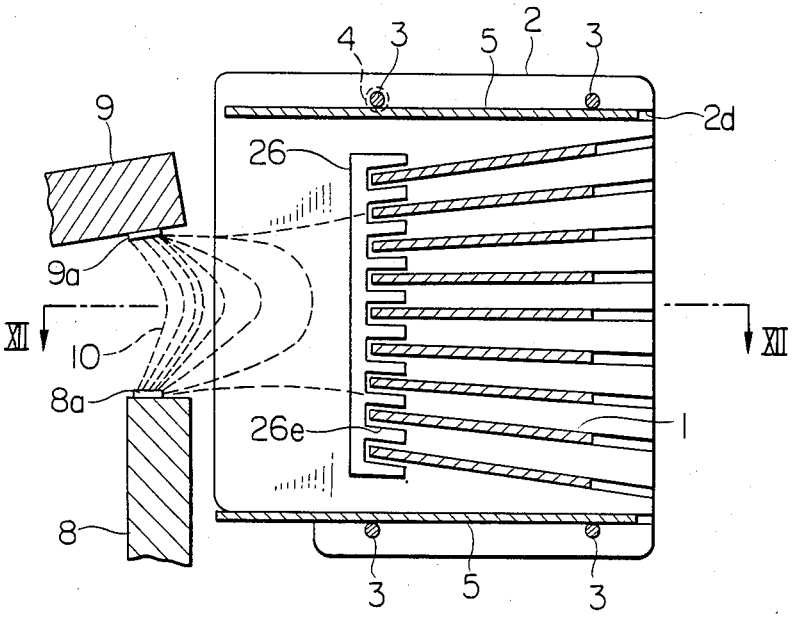
FIG. 11 is a partially sectional side view showing the arc chute in FIG. 6A in combination with a switch.
Figure 12:
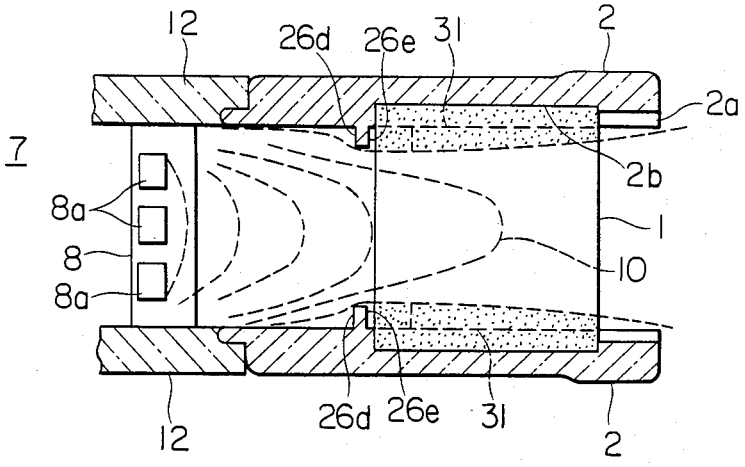
FIG. 12 is a partially sectional plan view of the arc chute taken along Line XII—XII in FIG. 11.

FIGS. 6A, 6B, 11, and 12 show a third embodiment of the present invention. In this embodiment, as shown in FIGS. 6A and 6B, a comb-shaped deflector projection 26 on the inner side of each side member 2 has a side 26d on the contact side generally perpendicular to the inner side surface of each side member 2, and a recessed portion 26e partially surrounding and spaced from each end of the arc plates 1 on the contact side. Namely, as shown in FIGS. 11 and 12, a gap is disposed between each recessed portion 26e of the projections 26 and each end of the arc plates 1 on the contact side, and each recessed portion 26e of the projections 26 partially surrounds each end of the arc plates 1 on the contact side. Accordingly, the flow of the hot gas caused by arcs 10 is not directed to the inner sides of the side members 2, but is deflected by the comb-shaped projections 26 toward the central portion between the side members 2, forming stationary regions 31 of no gas flow along the inner side surfaces of the side members 2. Therefore, portions of the side members 2 in which the arc plates 1 are retained are not directly exposed to the hot gas so that these portions are not damaged by the heat of the hot gas. When a gap is not disposed between each projection 26 and each end of the arc plates 1 on the contact side, the portions in which the projections 26 directly contact the ends of the arc plates 1 are exposed to the hot gas and tend to be damaged by the heat of the hot gas, resulting in the dielectric breakdown of these portions so that it becomes meaningless to dispose projections so as to prevent the hot gas flow from going forward along the inner sides of the side members 2.

In the above three embodiments, one projection is disposed on the inner side of each side member, but a similar effect can be obtained when two or more projections are disposed on the inner side of each side member.

As mentioned above, in an arc chute for a circuit breaker according to the present invention, projections are disposed on the inner sides of a pair of side members and spaced from a plurality of spaced apart arc plates, so that stationary regions of the hot gas caused by arcs generated by the opening of contacts are formed by the projections along the inner sides of the side members. Accordingly, portions in which the arc plates are retained by the side members are not exposed to the hot gas flow and are prevented from being damaged by the heat of the hot gas. Dielectric breakdown of the arc chute is thereby greatly decreased and a durable arc chute can be obtained. Furthermore, when the projections partially surround the ends of the side members on the contact side, the sizes of the projections in the direction of the gas flow can be arbitrarily selected so as to achieve desired shapes and sizes of the stationary regions.

What is claimed is:

1. An arc chute for a circuit breaker comprising:

a plurality of spaced apart arc plates disposed in proximity to arc contacts for extinguishing an electric arc and receiving a hot gas generated by the arc and flowing downstream from said arc contacts to said arcs plates;

a pair of spaced apart, substantially parallel side members retaining the arc plates therebetween; and deflector means projecting from the inner surface of each of said side members to which said arc plates are attached, said deflector means extending substantially perpendicular to said arc plates and being spaced upstream from said arc plates and located downstream of said arc contacts, said deflector means projecting toward the opposide side member and protruding into the path of the hot gas flowing from the arc contacts along inner faces of the side members to deflect the hot gas before the hot gas enters the spaces between the arc plates so that the hot gas is prevented from contacting the portions of the inner faces of the side members downstream of the projecting deflector means where said arc plates are retained.

2. An arc chute for a circuit breaker as claimed in claim 1 wherein said deflector means has a side surface generally perpendicular to said inner surface of said side members.

3. An arc chute for a circuit breaker as claimed in claim 1 wherein said deflector means has a slanting side surface on the contact side to direct the gas flow to the inner surfaces of the side members.

4. An arc chute for a circuit breaker as claimed in claim 1 wherein the deflector means partially surround end portions of the arc plates facing said contacts with a gap between each deflector means and each of said arc plate end portions.

5. An arc chute for a circuit breaker comprising:

a plurality of spaced apart arc plates disposed in proximity to arc contacts for extinguishing an electric arc and receiving a hot gas generated by the arc and flowing downstream from said arc contacts to said arc plates;

a pair of spaced apart, substantially parallel side members retaining the arc plates therebetween;

deflector means projecting from the inner surface of each of said side members to which said arc plates are attached, said deflector means extending substantially perpendicular to said arc plates and being spaced upstream from said arc plates and located downstream of said arc contacts, said deflector means projecting toward the opposide side member and protruding into the path of the hot gas flowing from the arc contacts along inner faces of the side members and deflecting the hot gas before the hot gas enters the spaces between the arc plates so that the hot gas is prevented from contacting the portions of the inner faces of the side members downstream of the projecting deflector means where said arc plates are retained; and said deflector means partially surrounding end portions of the arc plates facing said contacts with a gap between each deflector means and each of said arc plate end portions.

* * * * *